US008347968B2

(12) United States Patent
Debard et al.

(10) Patent No.: US 8,347,968 B2
(45) Date of Patent: Jan. 8, 2013

(54) SINGLE TRIP WELL COMPLETION SYSTEM

(75) Inventors: Julien Debard, Houston, TX (US); Felix Estilette, Jr., Missouri City, TX (US); Dinesh R. Patel, Sugar Land, TX (US); Bryan Stamm, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 282 days.

(21) Appl. No.: 12/621,896

(22) Filed: Nov. 19, 2009

(65) Prior Publication Data

US 2010/0175894 A1 Jul. 15, 2010

Related U.S. Application Data

(60) Provisional application No. 61/144,580, filed on Jan. 14, 2009, provisional application No. 61/157,627, filed on Mar. 5, 2009.

(51) Int. Cl.
*E21B 43/00* (2006.01)

(52) U.S. Cl. ..... 166/369; 166/373; 166/51

(58) Field of Classification Search ..... 166/313, 166/373, 369, 278, 51
See application file for complete search history.

(56) References Cited

U.S. PATENT DOCUMENTS

| | | | | |
|---|---|---|---|---|
| 3,387,659 | A | 6/1968 | Current | |
| 6,378,609 | B1 | 4/2002 | Oneal et al. | |
| 6,405,800 | B1 * | 6/2002 | Walker et al. | 166/278 |
| 6,571,875 | B2 | 6/2003 | Bissonnette et al. | |
| 6,766,857 | B2 * | 7/2004 | Bixenman et al. | 166/278 |
| 6,837,310 | B2 | 1/2005 | Martin | |
| 6,848,510 | B2 | 2/2005 | Bixenman et al. | |
| 7,066,264 | B2 | 6/2006 | Bissonnette et al. | |
| 7,108,073 | B2 * | 9/2006 | Patel | 166/386 |
| 7,322,422 | B2 | 1/2008 | Patel | |
| 7,367,395 | B2 * | 5/2008 | Vidrine et al. | 166/278 |
| 2003/0221829 | A1 | 12/2003 | Patel et al. | |
| 2007/0119598 | A1 | 5/2007 | Turner et al. | |
| 2007/0227727 | A1 | 10/2007 | Patel et al. | |
| 2007/0251690 | A1 | 11/2007 | Whitsitt et al. | |
| 2009/0078421 | A1 | 3/2009 | Guignard et al. | |
| 2009/0095471 | A1 * | 4/2009 | Guignard et al. | 166/278 |
| 2010/0163235 | A1 * | 7/2010 | Mootoo et al. | 166/278 |

* cited by examiner

*Primary Examiner* — Nicole Coy

(57) ABSTRACT

A completion system that is usable with a well may include a packer, a screen, an isolation valve and an annulus communication valve. The screen communicates well fluid between an annulus of the well and an interior passageway of the completion system. The isolation valve is radially disposed inside the screen to control communication through the screen between the annulus and the interior passageway. The annulus communication valve is located downhole of the packer and uphole of the screen to control communication with the annulus of the well. The packer, screen, isolation valve and the annulus communication valve are adapted to be run downhole as a unit into the well as a single trip completion.

19 Claims, 8 Drawing Sheets

250
14
20
254

250
14
254
20

260
14
264
20

260
264
14
270
20

270
14
20

SINGLE TRIP WELL COMPLETION SYSTEM

RELATED APPLICATIONS

This application claims the benefit under 35 U.S.C. §119 (e) to U.S. Provisional Patent Application Ser. No. 61/144,580, entitled, "SINGLE TRIP COMPLETION SYSTEM," filed on Jan. 14, 2009, and U.S. Provisional Patent Application Ser. No. 61/157,627, entitled, "SINGLE TRIP COMPLETION SYSTEM," filed on Mar. 5, 2009. Each of these applications is hereby incorporated by reference in its entirety.

BACKGROUND

1. Field of Invention

The invention generally relates to a single trip well completion system.

2. Description of the Related Art

The following descriptions and examples are not admitted to be prior art by virtue of their inclusion in this section.

For purposes of forming a well to extract a hydrocarbon-based fluid (oil or natural gas) from a subterranean, hydrocarbon-bearing geologic formation, or to inject water into or around a subterranean, geologic formation, for example, among other purposes not specifically identified but included herein, a wellbore is first drilled into the formation. Completion equipment, which typically includes a complex system of tubes and valves to regulate flow of the fluid, is then installed in the wellbore.

At least two runs, or trips, into the wellbore typically are required for purposes of installing the completion equipment. A lower completion is commonly run first to the heel of the wellbore, which may be located furthest from the surface. Subsequent to this run, an upper completion is commonly run into the well to provide the tubing and mechanisms required to connect the lower completion to a hydrocarbon removal point or wellhead location, for example.

Each trip into the well adds to the cost and complexity of completing the well. Thus, there is a continuing need for better ways and systems to minimize the number of trips to complete a well. However, the detailed description below may be used to resolve other needs and applications not specifically identified, but apparent to a person of skill in the art.

SUMMARY

In an example, a completion system that is usable with a well may include a packer, a screen, at least one isolation valve and an annulus communication valve. The screen communicates well fluid between an annulus of the well and an interior passageway of the completion system. The isolation valve(s) may each be radially disposed inside the screen to control communication through the screen between the annulus and the interior passageway. The annulus communication valve may be located downhole of the packer and uphole of the screen to also control communication between the annulus and the interior passageway of the well. The packer, screen, isolation valve(s) and the annulus communication valve are adapted to be run downhole as a unit into the well.

In another example, a completion system that is usable with a well may include a first packer, an annulus communication valve, an inner tubing and at least one zone assembly. The annulus communication valve may be located downhole of the packer and uphole of the screen to control communication between an annulus and interior passageway of the well. Each zone assembly may include a screen, at least one isolation valve and a second packer. The screen communicates well fluid between the annulus of the well and the interior passageway of the inner tubing via one or more isolation valves. The isolation valve(s) are each radially disposed inside the screen to control communication through the screen between the annulus of the well and the interior passageway. The first packer, screen, the annulus communication valve, the inner tubing and the zone assembly(ies) are adapted to be to be run downhole as a unit into the well.

Advantages and other features of the invention will become apparent from the following drawing, description and claims.

BRIEF DESCRIPTION OF THE DRAWING

Certain examples will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following description, numerous details are set forth to provide an understanding of embodiments of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. Moreover, the term "sealing mechanism" includes: packers, bridge plugs, downhole valves, sliding sleeves, baffle-plug combinations, polished bore receptacle (PBR) seals, and all other methods and devices for blocking the flow of fluids through the wellbore.

Figure 1:
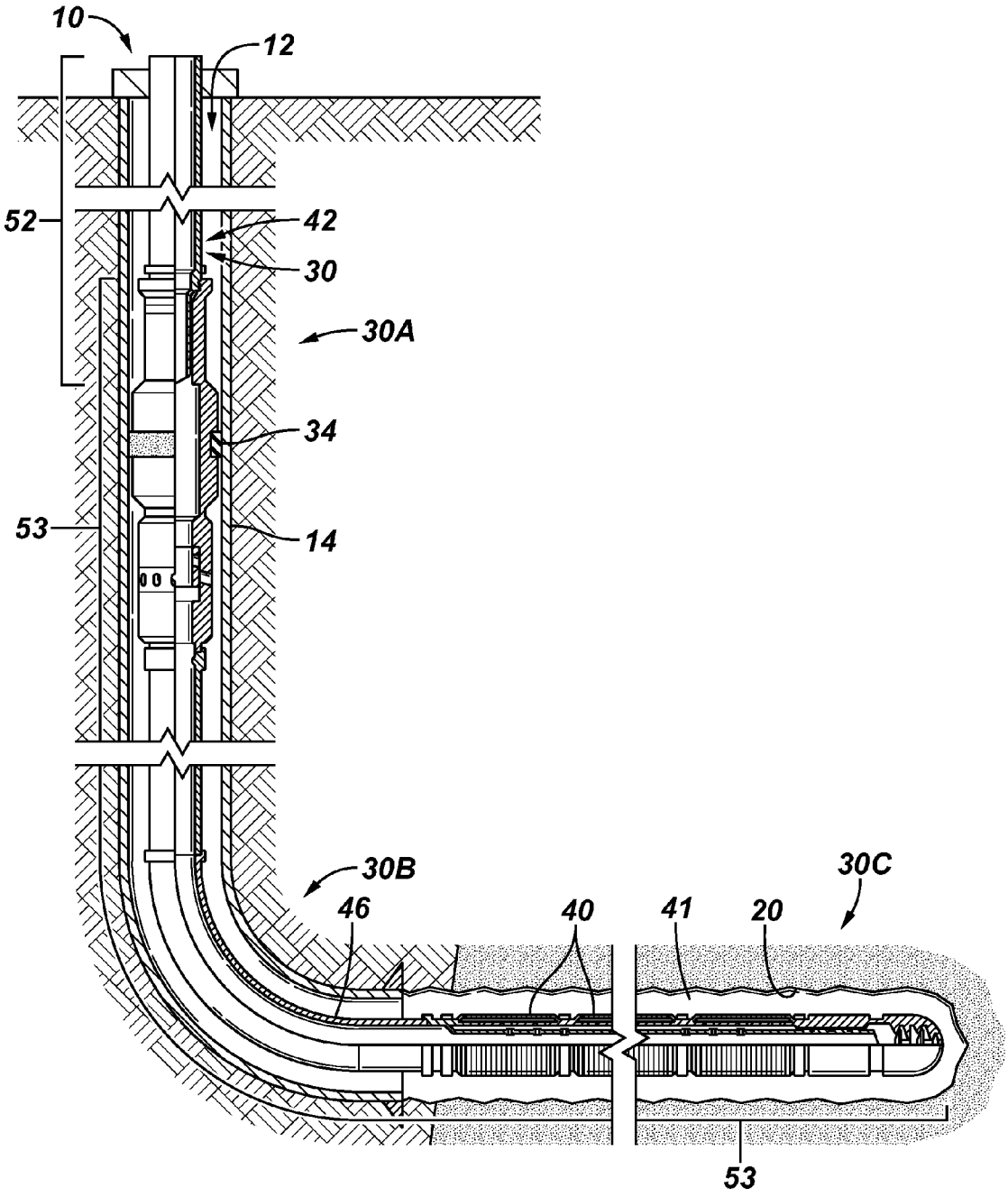
FIG. 1 is a schematic diagram of a well according to an example.

As an example, FIG. 1 depicts a well 10, which includes at least one wellbore 12 that extends through one or more formations that contain a hydrocarbon-based fluid. For the example depicted in FIG. 1, the wellbore 12 includes a first segment that is cased by a casing string 14 and a lateral, uncased open hole segment 20. It is noted that the well 10 may have more than one lateral segment, and the well 10 may be entirely cased in other examples. Additionally, although FIG. 1 depicts a subterranean terrestrial well as a non-limiting example, the systems and techniques that are disclosed herein may likewise be applied to subsea as well as vertical or slightly deviated wells, among others.

In the well 10, a single trip completion system 30 has been installed. For this example, the single trip completion system 30 is part of a tubular string 42 with any standard upper completion equipment (not shown), which extends to the surface of the well 10 and hangs from a tubing hanger provided at its upper end. As depicted in FIG. 1 for this example, the single trip completion system 30 is disposed at the end of the string 42.

As its name implies, the single trip completion system 30 requires only a single trip into the well 10 for purposes of installing what has conventionally been considered upper and lower completions and here, are referred to as upper 52 and lower 53 sections, respectively, of the system 30. Unlike typical conventional completions, the entire system 30 is run downhole as a single unit using a single trip into the well 10.

As described further below, the upper 52 and lower 53 sections are sealed to each other, and are mechanically and optionally releasably connected to each other through an optionally provided, selectably releasable anchor latch 50 (see FIG. 2), which is described below. The seal between the sections 52 and 53 may be formed using a polished bore receptacle (PBR) 54 that is located at the upper end of the lower section 53. In this regard, referring to FIG. 2 in conjunction with FIG. 1, the upper section 52 may have an extension 60 at its lower end, which is designed to reside within and seal to the PBR 54. As an example, the extension 60 may include sealing rings 61 (o-rings, for example) for purposes of forming a seal between the upper 52 and lower 53 sections.

Referring to FIG. 1, in general, the lower section 53 of the single trip completion system 30 may include screens 40, which are concentrated together and extend into the uncased, open hole segment 20 of the wellbore 12. In other examples, the screens 40 could extend inside of the casing if the well were entirely cased. The screens 40, in general, are located near the lower end of the lower section 53 and communicate well fluid from an annular region 41 (i.e., the "annulus") that surrounds the screens 40 into the central passageway of the system 30 (and string 42).

The single trip completion system 30 may form an annular seal between the exterior of the system 30 and the interior surface of the casing string 14 through the setting of a packer 34, which is part of the lower section and is disposed near the upper end of the section 53. Due to this arrangement, produced well fluid is directed to flow through the screens 40, into the system 30 and thus, into the string 42 to the surface of the well.

As an example, the packer 34 may a hydraulically-set packer. Alternatively, the packer 34 may be another type of packer (a weight set or swellable packer, for example) that is set by another mechanism.

For the example in which the packer 34 is a hydraulically-set packer, the packer 34 may be set using the internal tubing pressure that is conveyed downhole through the central passageway of the string 42 (and single trip completion system 30). In this regard, the system 30 may include a washdown shoe 140 at its lower end, which may be configured to accept at least one plug 142 (see FIG. 4). The plug(s) 142 may seal off the internal passageway of the single trip completion system 30 below the packer 34. The sealing of the internal passageway of the system 30 allows for a build up or increase in pressure necessary to set the packer 34.

As an example, the washdown shoe 140 may contain a ball seat that accepts a ball plug that is deployed (e.g., dropped and/or pumped) from the surface of the well. However, other types of valves may be used for purposes of creating the sealed volume in the central passageway of the system 30 for purposes of actuating the packer 34, in accordance with other variations. For example, formation isolation valves (FIV)(not shown) may be used to reversibly seal or prevent communication between one portion of the internal passageway of the system 30 and another portion of the internal passageway.

For purposes of releasing the packer 34, the packer 34 may be configured as a straight pull release packer, as a non-limiting example. Accordingly, in the case of a well control situation in which the packer 34 had to be set off depth and afterwards needs to be released, the straight pull release permits the releasing of the packer 34 and the pulling of the entire completion in the same trip.

The packer 34 may be a multiple port packer. In general, a multiple port packer allows for multiple feedthroughs for control lines and/or communication cables (electrical cables, optical cables, etc.) to extend in the annulus between portions of the system 30 separated by the packer 34. The packer 34 may be V0 rated and may have a cut to release mechanism for tensile pulling of the packer 34. Other variations are contemplated. For example, the packer 34 may alternatively be mechanically set or set via a control line. For subsea wells, a remotely operated vehicle (ROV) may be used to set the packer 34 using the control line if necessary.

As described in more detail below, the packer 34 is one of a number of potential components of the single trip completion system 30, which facilitate the cleanup of the well and well displacement. Furthermore, the single trip completion system 30 may have features that permit detachment and separation of the upper section 52 from the lower section 53. The single trip completion system 30 is also compatible with various mud systems, is deployable in deepwater environments, subsea environments and general terrestrial well systems. Furthermore, the single trip system 30 is compatible with various types of completion components. In some cases, the single trip system 30 may provide for water injection or other forms of well operation alternatively or in addition to hydro-carbon production.

In general, the components of the single trip completion system 30 may include, as a non-limiting list of examples, a packer, a washdown shoe system, lateral check valve system, pressure actuated sliding sleeves, electronic trigger actuation mechanisms, annular flow control valves, isolation valves, formation isolation valves, safety valves, sensors, screens, a releasable anchor latch, etc. Exemplary components are described below in more detail in connection with sections 30A, 30B and 30C of the system 30, which respectively appear in FIGS. 2, 3 and 4.

Figure 2:
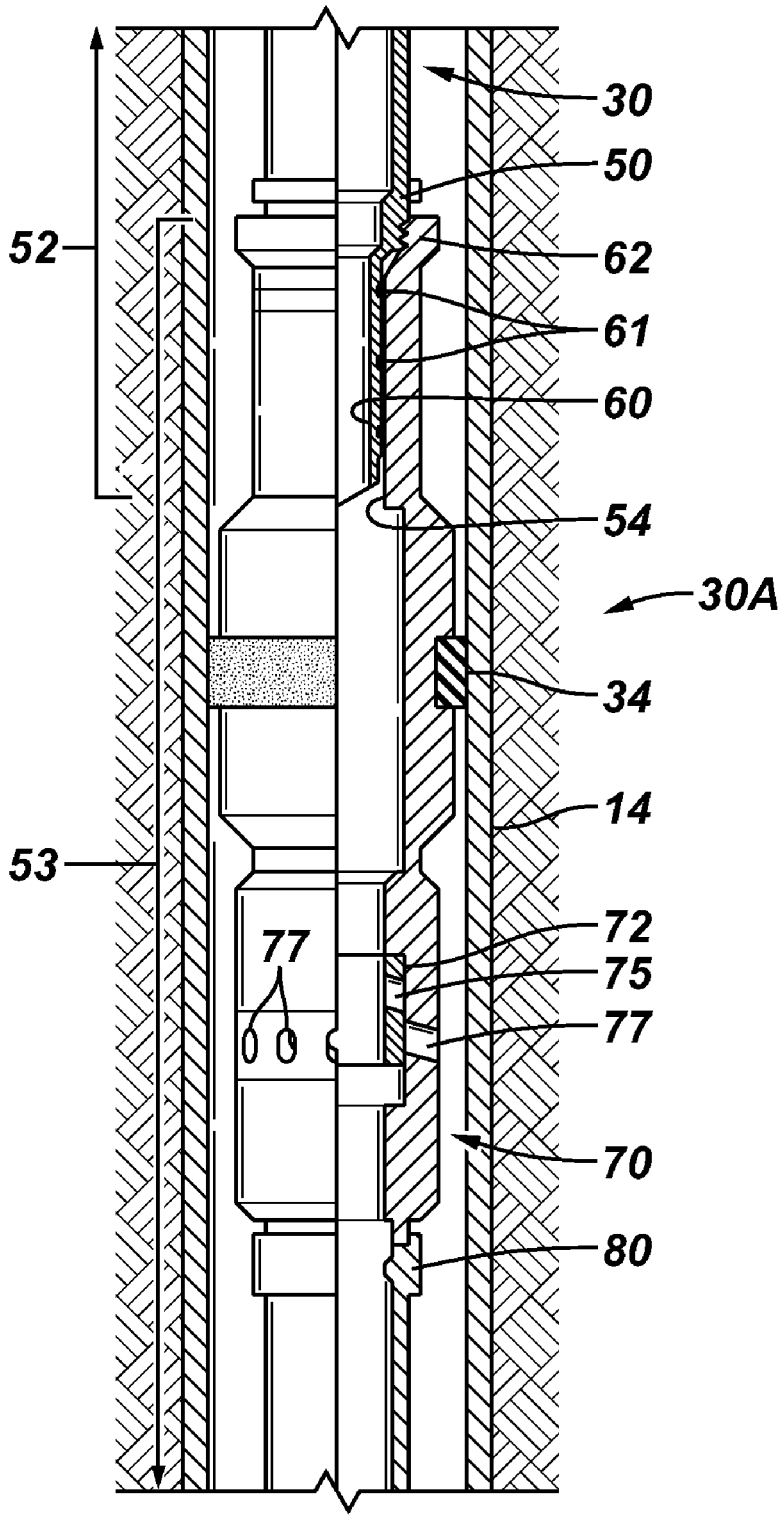
FIGS. 2, 3 and 4 are schematic diagrams of sections of a completion system of the well of FIG. 1 according to an example.

Referring to FIG. 2, as an example of one of the components of the single trip completion system 30, the releasable anchor latch 50 may be hydraulically actuated (as an example) to permit the separation of the upper section 52 from the lower section 53 for purposes of workover or as part of a contingency plan should a problem arise in the installation of the system 30. For example, upon running the single trip completion system 30 downhole, an open hole obstruction may be encountered and the string may get stuck, which would require the packer 34 to be set at a higher position than originally desired. When this situation arises, the release mechanism of the anchor latch 50 may be actuated to separate the upper section 52 from the lower section 53 so that an operator may pull out the upper section 52 from the well 12 and reconfigure the spacing of the components of the system 30 in order to properly land the tubing hanger. As another example, another contingency may be that the packer 34 may need to be prematurely set because of a well control situation, or may be unintentionally prematurely set, such as the case when the packer 34 is a swellable packer, for example.

As an example, the anchor latch 50 may be actuated through a hydraulic control line that extends to the surface of the well. The use of the control line permits the release of the anchor latch 50 even before the packer 34 sets or in case the packer 34 does not set. The control line actuated release also allows the anchor latch 50 to be relatively insensitive to dynamic pressure within the well system, which may be created through the circulation of the various well fluids. This insensitivity may help to prevent early and/or unintentional release of the anchor latch 50 if circulating pressure reaches higher values or levels than planned.

Depending on the particular implementation, the control line, which controls the anchor latch 50, may be a separate, dedicated control line or the control line may be one of the lines that are used to control other components of the single trip completion system 30, such as the packer 34, for example. As another example, the same control line that is used to control other components, such as the annular flow control valve 70 (described below), may alternatively be used. For this example, an interface, such as a counter or signal identifier, may aid in identifying and separating the hydraulic actuation signals for each of the individual components. As a contingency, the anchor latch 50 may be disconnected with rotation.

The anchor latch 50 may also be actuated by annular pressure instead of through stimuli that are communicated through a control line. In such a case, no control line is used. As other examples, the actuation of the anchor latch 50 may be accomplished through the use of an electronic signal that is communicated downhole wirelessly or via a wire. The electronic triggering device may be further coupled to a tubing port or an annular port or pumped downhole such as with a radio frequency emitter.

As an example, the anchor latch 50 may include a threaded connection that is configured to at least support the weight of the portion of the single trip completion system 30 below the anchor latch 50. The threaded connection may still provide the ability to pass through or work through the central passageway of the latch 50 if required. In some cases, the threaded connection of the anchor latch 50 may be cut to release in order to provide a simple and reliable way to disconnect the upper section 52. However, in accordance with other examples, the release may also involve a time delayed mechanism. Thus, many variations are contemplated and are within the scope of the appended claims.

Still referring to FIG. 2, another component of the single trip completion system 30 may include a latch crossover 62. The latch crossover 62 may permit the single completion system 30 to be configured with a variety of choices for the anchor latch thread. In some cases, the anchor latch thread may be selected with regard to tensile strength. As depicted in FIG. 2, the anchor latch 50 and latch crossover 62 are provided uphole of the packer 34.

The single trip completion system 30 may further include a grooved sub in order to facilitate the cutting of any control lines if the upper section 52 is pulled. The sub may allow the disconnection and cutting of the control line below a re-entry profile so that the control line does not prevent re-entry. However, a potential leak path may be created once the control line is cut if the control line is not plugged properly. In such a case, an extra packer (not shown) may be run on top of the lower completion after pulling the upper completion.

As a non-limiting example, the above-described grooved sub may include a wet mate connector. The wet mate connection may be made on the surface and then used in order to ease any subsequent disconnection or reconnection if needed. In addition, the groove may be designed specifically to facilitate later cutting of the sub. In other cases, the groove sub may include a line management/cutting system.

As also depicted in FIG. 2, the single trip completion system 30 may include an annular flow control valve (FCV) 70, which may be located downhole of the packer 34. As described further below, the valve 70 may be configured to facilitate circulation of fluids between the interior central passageway of the system 30 (and string 42 (see FIG. 1)) and the annular space of the well surrounding the system 30. As further described below, when open, the valve 70 functions to configure the system 30 with an automatic fill capability as the system 30 is being run downhole. Depending on the particular implementation, the valve 70 may be operated by a control line and may be operable at anytime while the system 30 is being run in hole and after the tubing hanger for the string 42 has landed. The valve 70 may use a wireless communication system (as a non-limiting example) to open and close the valve 70 or to indicate the position of the valve 70, for example, such as the case when the valve 70 is electrically operated.

As another example, the valve 70 may be operated by dual control lines or a single control line that is coupled to a hydraulic switch. Thus, many variations for controlling the valve 70 are contemplated and are within the scope of the appended claims.

The valve 70 may include a Nitrogen inert gas charge (a Nitrogen gas charge, for example) or mechanical spring to aid in its actuation, depending upon the conditions of the well system. The valve 70 may have any of a number of sizes, such as, but not limited to, 5½, 4½ or 3½ inches. Selection of an appropriate size for the opening through the valve 70 depends at least in part on the anticipated flow rate that is expected through the valve 70.

As a non-limiting example, the valve 70 may be a sleeve valve, which has an inner sleeve 72 that may be actuated to align ports 75 of the sleeve 72 with corresponding housing ports 77 when the valve 70 is open. Conversely, when the valve 70 is closed, the ports 74 and 77 are not aligned.

It is noted that the inner sleeve 72 may be configured to be mechanically operated via a shifting tool that is run downhole into the central passageway of the system 30. The use of a shifting tool may be used in the case when the valve 70 fails to operate. The sleeve 72 may have an interior profile that is accessible through the central passageway of the system 30 such that an exterior profile of the shifting tool may engage the interior profile of the sleeve 72 for purposes of shifting the sleeve 72 to the desired open or closed position.

As also depicted in FIG. 2, the lower section 53 may include a no go nipple 80, which is located downhole of the valve 70. In general, the no go nipple 80 is an interior profile in the central passageway of the single trip completion system 30, which is constructed to receive a plug for a contingent workover operation, as further described below.

Figure 3:
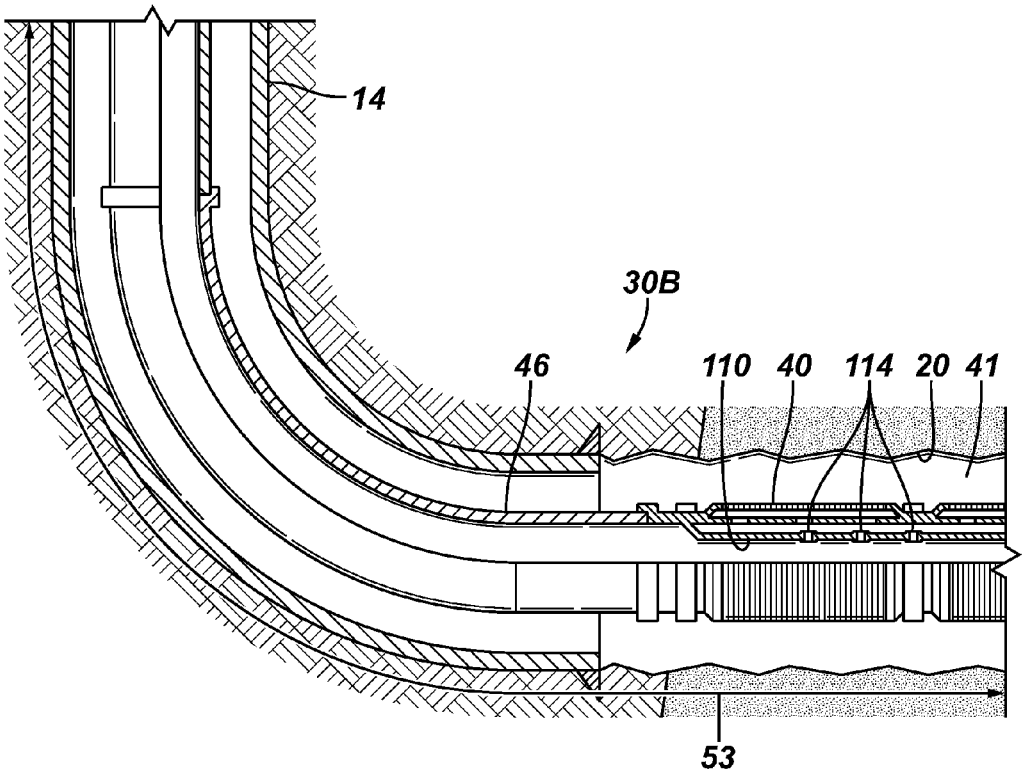
Figure 4:
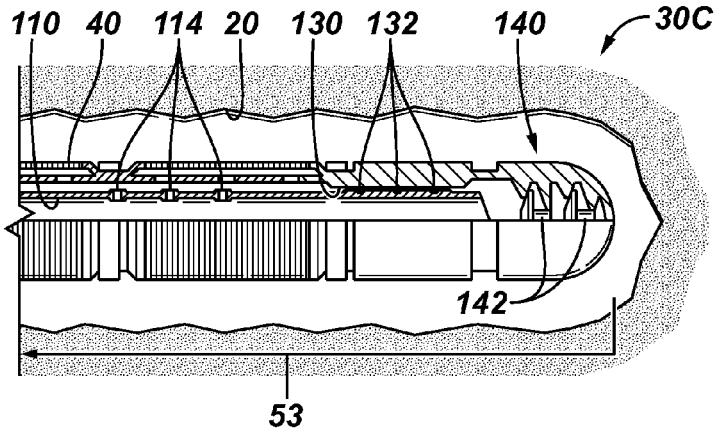

Referring to FIGS. 3 and 4 as a non-limiting example, flow control devices may be incorporated into the screens 40 of the lower section 53 to control fluid communication through the screens 40 between the annulus 41 and the central passageway of the system 30. For example, the lower section 53 may include an inner tubing 110 that extends inside of the screens 40 and includes inflow control devices 114. In general, the inner tubing 110 creates a sealed access to the central passageway of the single trip completion system 30. In this regard, at its uphole end, the inner tubing 110 may, for example, be connected to a base pipe 46 that extends to the no go nipple 80. The lower end of the inner tubing 110 may be sealed through seals 132, which reside inside a polished bore receptacle (PBR) 130. The flow control devices 114 may be check valves that are incorporated into the inner tubing 110. As another example, the flow control devices 114 may be sliding sleeve valves. In general, the flow control devices 114 may be actuated electronically, hydraulically, mechanically, or using some other actuation technique, as many variations are contemplated and are within the scope of the appended claims.

At its lower end, the lower section 53 may include the washdown shoe 140, which is constituted of 2 check valves to control communication between the interior of the single trip completion system 30 and the surrounding well environment.

Figures 6A, 6B, 6C, 6D, 6E:
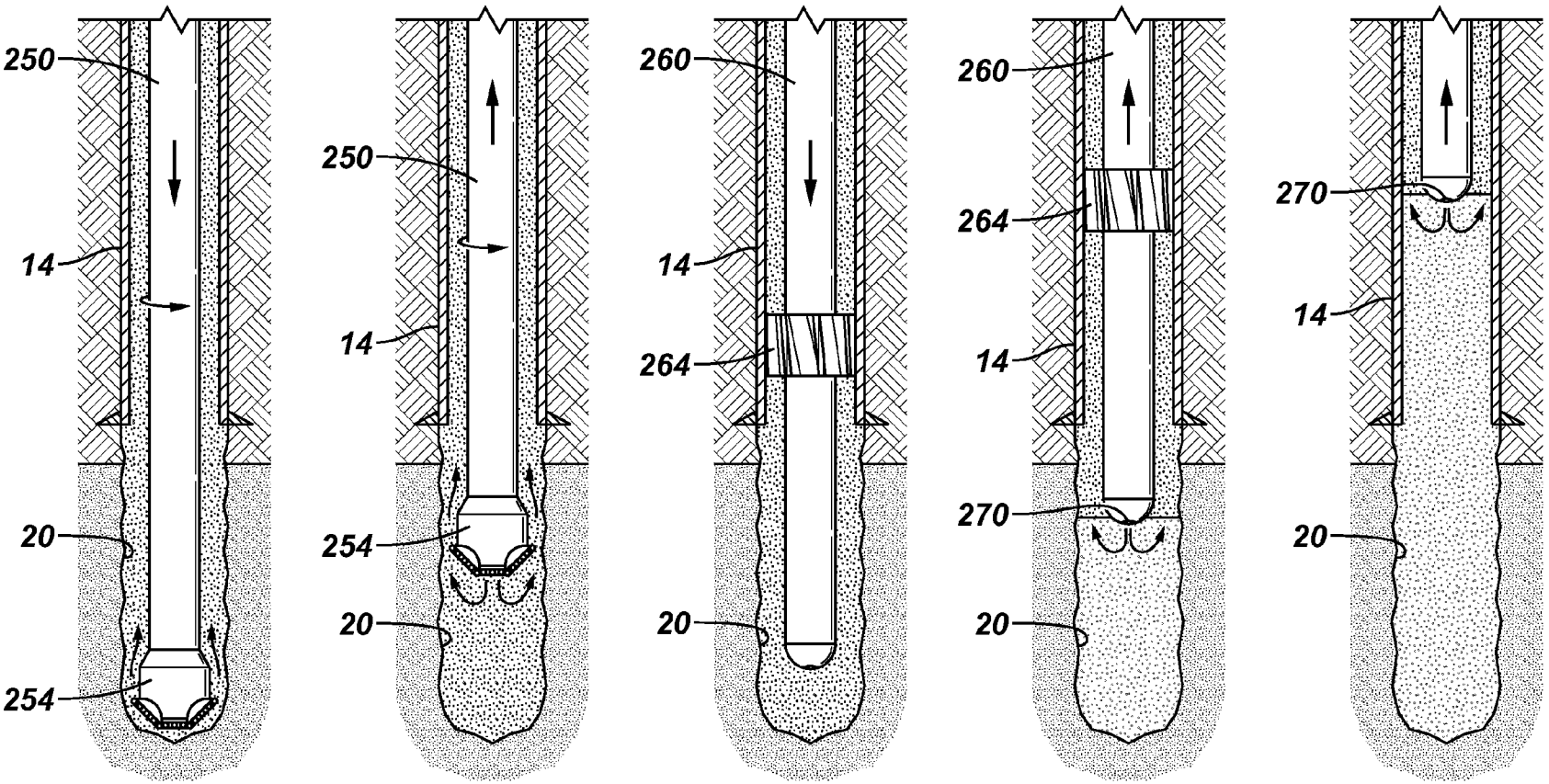
FIGS. 6A, 6B, 6C, 6D and 6E are schematic diagrams illustrating preparation of a well before the single trip completion system is run downhole according to an example.

The single trip completion system 30 may be installed in the well 10 (see FIG. 1) as follows. First, several preliminary actions are employed for purposes of preparing the wellbore 12 before the system 30 is run into the well 10. These actions are illustrated in connection with FIGS. 6A-6E. In general, the actions include drilling the open hole wellbore segment 20 (see also FIG. 1) with reservoir drilling fluid (RDF), such as an oil-based mud (OBM), to prevent shale swelling and to form filtercake. FIG. 6A depicts a drilling string 250 that has an associated drilling bit 254 to drill the open hole wellbore segment 20 (see also FIG. 1), which extends from the cased segment 14 of the wellbore 12.

As illustrated in FIG. 6B, the open hole wellbore segment 20 is back reamed with conditioned oil-based mud to ensure that the open hole segment 20 is clear of debris. The back reaming may continue to a point back up inside of the casing 14. The rate of reaming may be increased once inside of the casing 14 in order to aggressively remove debris that may have settled in the built up section of the well. High viscosity conditioned oil based mud sweeps may be pumped at a rate that is sufficient enough to lift debris. After reaming, the drill string 250 is retrieved from the well 10.

Referring to FIG. 6C, a wiper clean up string 260 may then be run into the well 10 with one or more scrapers (such as a scraper 264 that is depicted in FIG. 6C as a non-limiting example) that are properly spaced out. This run in may be with conditioned oil based mud to the total depth without rotation or circulation in order to simulate a run in with screens. The open hole wellbore segment 20 may then be displaced with a cleaning fluid such as hydroxyethylcellulose (HEC) with a shale inhibitor while pulling the string 260 back up into the casing 14. This may require that proper spacers are added. Also, a compatibility test may be performed between HEC and the oil-based mud in order to determine the correct percentages of each. Once in the casing 14 just below the packer setting depth, the sweeps are pumped, and brine fluid is introduced, as depicted in FIG. 6D. The brine fluid exits ports 270 of the string 260 and reenters the well environment. Cleaning chemicals may be pumped in order to properly remove any mud film on the internal surface of the casing 14. At this point, the string 260 is removed from the well, as depicted in FIG. 6E.

The depth of the packer 34 (see FIG. 1) is selected such that the packer 34 is in an as vertical as possible section of the well, preferably above the built up section. Reasons for this positioning are as follows. If the remaining debris settles while running the completion, then this debris will accumulate in the built up section of the well 10. Positioning the packer 34 above this section may prevent the packer 34 from having to engage and move the debris in front of it during run in. In the case of the system 30 containing stand alone screens (SAS) 40, there may be a length of blank pipe 46 (see FIG. 1) that may be used to position and space out the various downhole components. In some cases, the blank pipe may be configured at the same size as the production tubing such that the production performance is not affected.

The volume of HEC left below the packer setting depth must be enough so that when running in hole and self filling the pipe through the annular valve 70 (see FIG. 2), a substantial enough quantity of HEC is placed in the pipe to allow for at least two complete displacements of the open hole/screen annular volume to account for the case in which a washdown is required. Furthermore, the longer the length is between the open hole and the packer 34 (see FIG. 1), the less swabbing effect will be seen by the formation. Additionally, at this point forward, the rig only has to handle water based fluids. The HEC may be stable with the filtercake, but an overbalanced state is maintained in the well.

The preliminary steps in assembling the single trip system 30 may include picking up and making up of the washdown shoe 140 and screens 40, along with the picking up and making up of the inner string 110 (if used). Next, the blank pipe 46 is added. The single trip completion system 30 may be filled with HEC by pumping HEC down the tubing through the washdown shoe 140. The amount of HEC used may be substantially equal to the volume required to fill the entire interior volume from the lowermost flow control valve 114 and the bottom of the washdown shoe 140.

Next, the annular valve 70 is made up. If lateral check valves are used as flow control devices 114 in the inner string 110, then the pipe may auto fill via lateral check valves, otherwise the annular valve 70 can left open for this purpose. Upon reaching the bottom of the casing, full of HEC for example from the previous steps, the inner string 110 and tubing will self fill with HEC, making it ready to be pumped if washdown is required.

Further preliminary actions may include picking up and making up the packer 34 with the control lines fed through. Additionally, a pup joint (with a length decided on due to the application conditions), may be made up as well. This pup joint may function as an extension and may provide a place in which to store settling debris on top of the set packer 34 without altering the function of the control line cutting groove sub and the hydraulic release anchor latch. An additional action may be to pick up and make up the control line cutting grooved sub and the latch crossover with its hydraulic release anchor latch. The latch crossover sub and the anchor latch may be made up in a workshop and shipped in this condition to the rig.

Figure 7D:
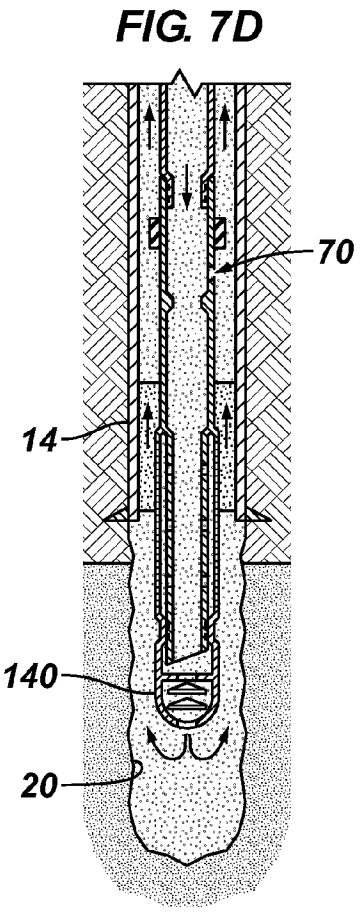
FIGS. 7A, 7B, 7C, 7D, 7E, 7F, 7G and 7H are schematic diagrams illustrating the installation of the single trip completion system according to an example.
Figure 7C:
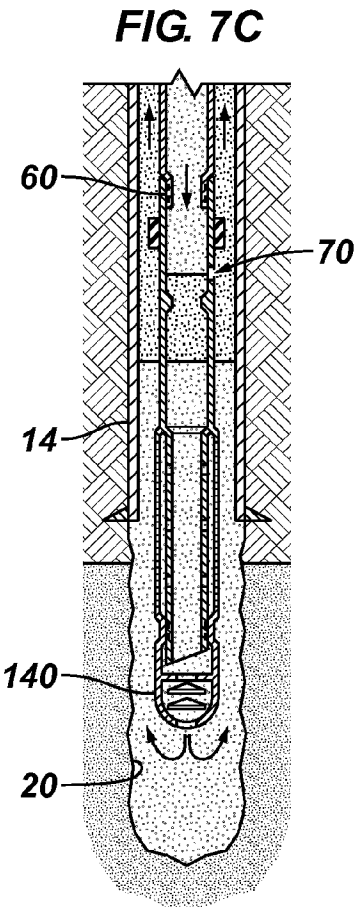

After the above-described preliminary steps are performed, the single trip completion system 30 may then be run into and installed in the well 10 as described below in connection with FIGS. 7A-7H. Referring to FIG. 7A, initially, the flow control devices 114 may be opened in the run-in-hole state of the system 30 so that the lower portion of the lower section 53 fills with the fluid in the well. Also during this state, the annular valve 70 may be open.

Figure 7B:
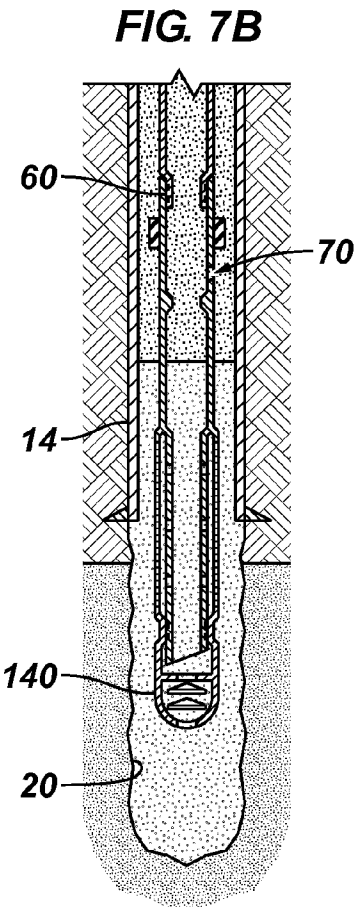
Figure 7A:
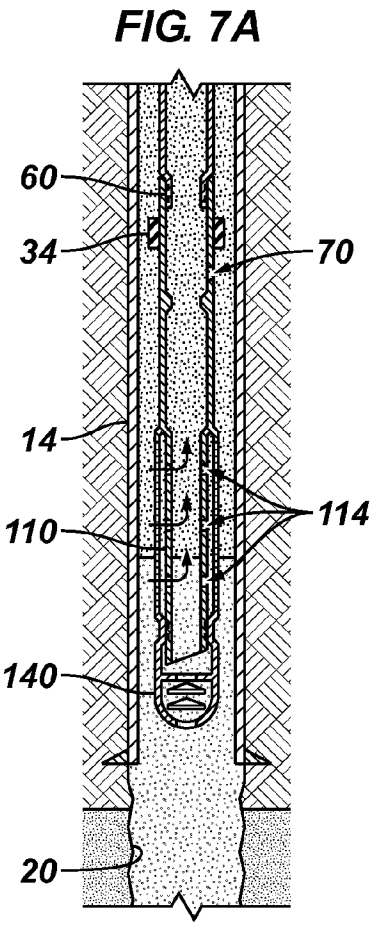

Referring to FIG. 7B, if washdown is required, the annular valve 70 may be closed, and the washdown may occur with the HEC previously placed inside the inner string volume and the HEC that was auto filled from the volume left at the bottom of the casing, as shown in connection with FIG. 7A. The rates are maintained below the maximum level acceptable prior to swabbing packer elements and may depend on the casing/packer size and type. If the volume of HEC contained within the tubing is not expected to be enough, the operator may stop circulating when the level of HEC with the shale inhibitor is at the depth of the annular valve 70, as depicted in FIG. 7C. More specifically, at this point, a new pill of HEC may be circulated through open valve 70 until it reaches the annular valve depth, as depicted in FIG. 7C. The annular valve 70 may then be closed and washing down may continue, as depicted in FIG. 7D.

Figure 7H:
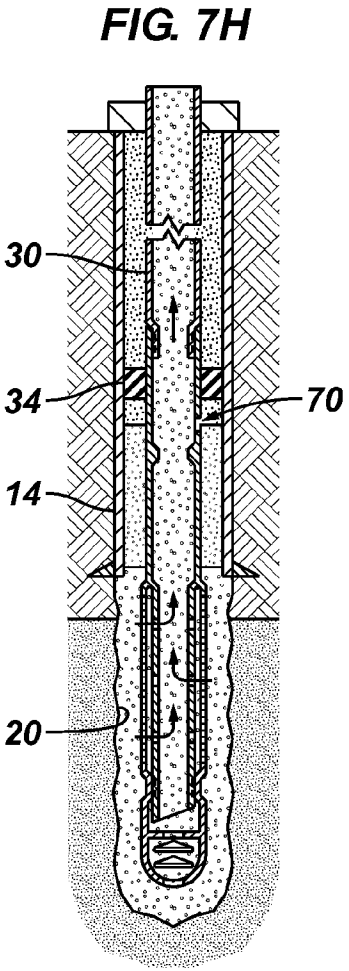
Figure 7G:
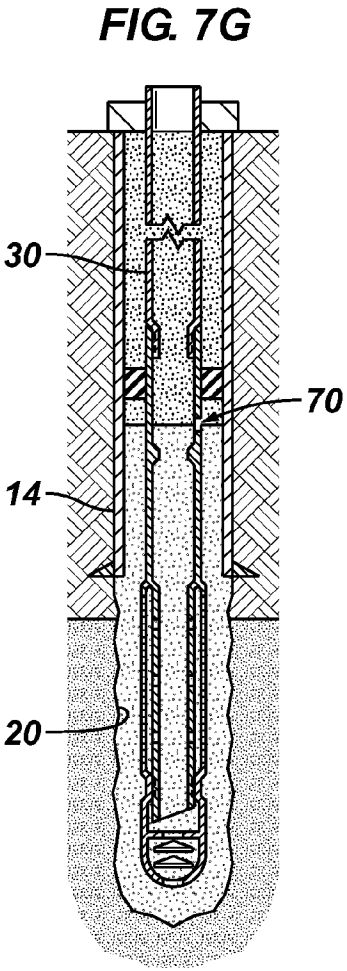
Figure 7F:
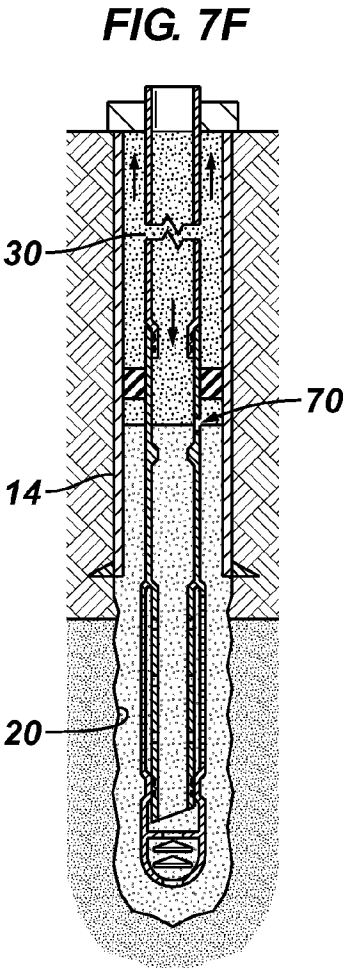
Figure 7E:
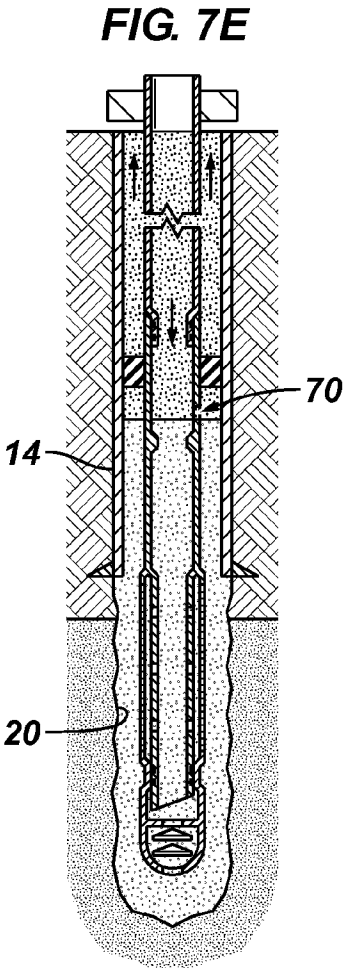

Once close to the bottom, the annular valve 70 may be opened, as depicted in FIG. 7E. If required, the filtercake treatment may be displaced to the top of the valve 70. In addition, the valve 70 may be closed, and the treatment may be pumped down the washdown shoe 140 and up the annulus of the open hole. The valve 70 may then be reopened. A high viscosity pill may be circulated at an appropriate rate from the annular port alongside the casing 14, proceeding up the annulus. Once the high viscosity pill has passed the packer restriction, the rate may be increased in order to lift debris. The brine rate along the packer may be controlled in order to prevent swabbing of the packer element. The pumped brine may have the proper oxygen scavenger component and corrosion inhibitor to be used as an adequate packer fluid.

Referring to FIG. 7F, the tubing hanger landing sequence may be initiated after the remaining debris is removed or washed away from the packer setting depth and from the tubing hanger landing seat. Once the tubing hanger is landed, the annular valve 70 may be closed, as depicted in FIG. 7G. Pressure may be applied to the control line in order to set the packer 34. The hydraulic release mechanism of the hydraulic release anchor latch 50 may be actuated as no movement is permitted. As depicted in FIG. 7H, the well is now in condition for production.

Figure 5:
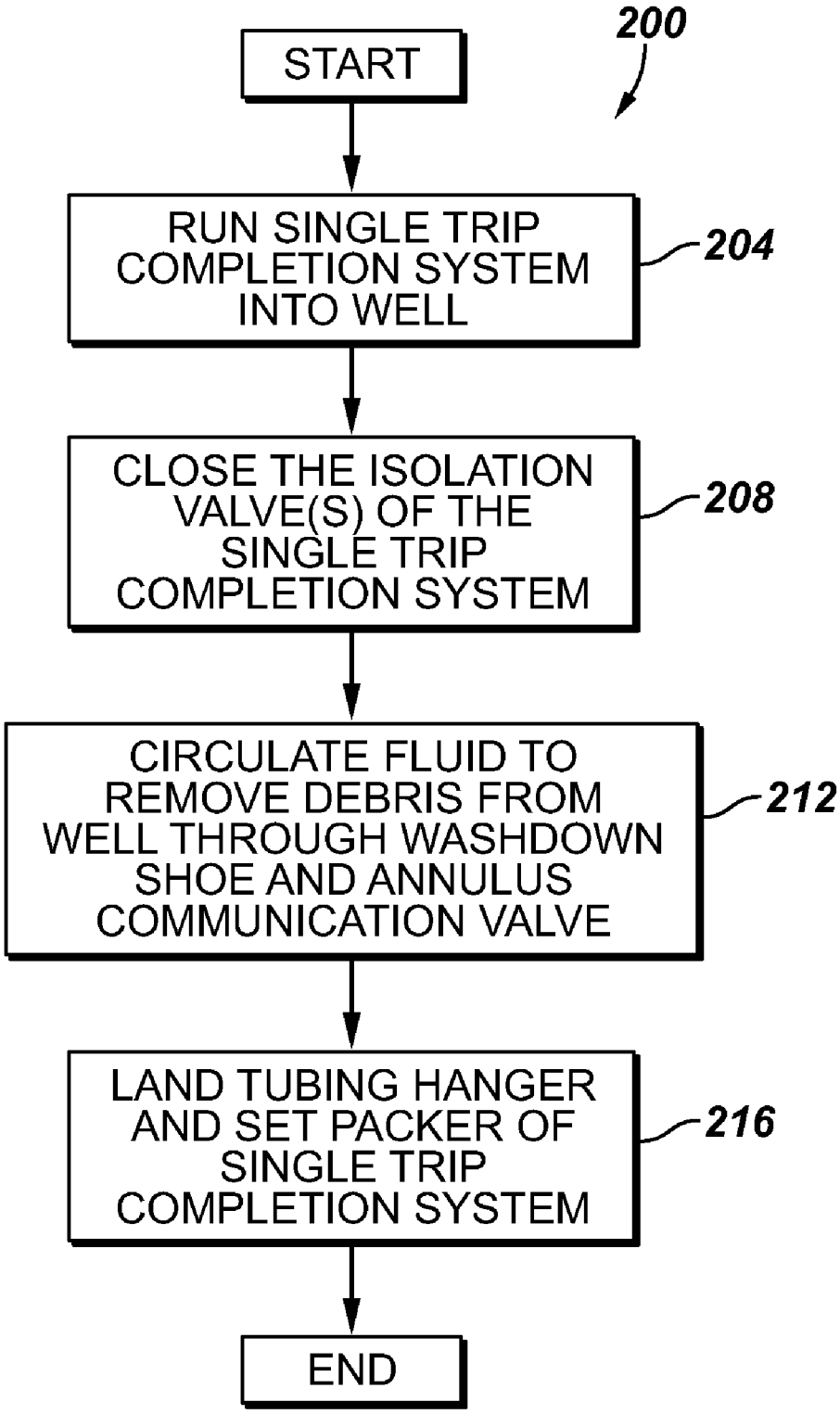
FIG. 5 is a flow diagram depicting a technique to complete a well according to an example.

Accordingly, referring to FIG. 5, in general, the single trip completion system 30 may be used pursuant to a technique 200. In the technique 200, the single trip completion system 30 is run as a unit to complete a segment of the well, as depicted in block 204. The unit may include at least one packer, at least one isolation valve and an annulus communication valve. The technique 200 includes closing the isolation valve(s), pursuant to block 208 and circulating fluid (block 212) to remove debris from the well in a path that extends to the bottom of the unit, into the annulus and through the annulus communication valve 70, pursuant to block 212. After the circulation, the technique 200 includes landing a tubing hanger of the unit and setting the packer, pursuant to block 216.

In order to further illustrate aspects of the claimed invention, some alternative methods may be used. For one option, conditioned mud may be kept in the open hole section while brine is kept in the casing section. There may be some advantages such as there should be no compatibility issues with filtercake, the filtercake may rebuild on the wellbore if damaged (this may be significant in cases in which the entire completion may be run relying on the filtercake and overbalance to control the well), and it allows the upper completion to be run in a brine environment. There may be some risks, such as if a washdown is required, then mud may be brought up along the upper completion during the washdown. Additionally, due to the metal displacement while running in hole or if a washdown is require, rig operators may have to manage trains of brine and conditioned mud coming back to the rig pits, potentially leading to mixing at the interfaces.

Further, if the tubing above the annular valve 70 is not yet completely filled with conditioned mud when washing down is required, then the volume of brine in the blank pipe between the top of the conditioned mud and the valve 70 is used for washdown, with an increased chance of impairing the filtercake. The valve 70 should be opened and mud displaced to the top of it by circulation. The valve 70 may then be closed and washdown started. Another option would be to keep conditioned mud in the entire well and displace to brine only prior to landing the tubing hanger and setting the packer 34.

In some cases, an unintended event may occur during the installation or use of the single trip completion system 30, thereby resulting in a contingency operation. For example, referring back to FIG. 1, if the single trip completion system 30 becomes stuck, or lodged, in the well 10 before reaching its final depth, the following procedure may be used. First, an attempt is made to wash the system 30 downhole. If this is unsuccessful, then an attempt is made to pull the system 30 out of the well. If the system 30 cannot be retrieved, pressure may be applied in a control line to set the packer 34, pressure up annulus and release hydraulic release anchor latch and pull the upper section 52 out of hole. Next, the appropriate tools are run downhole to retrieve the packer 34 and another attempt may then be made to pull the lower section 53 out of hole.

As another example of a contingency, the annular valve 70 may not close. If this happens, a shifting tool may be run down to mechanically close the sleeve of the valve 70 (assuming here that the valve 70 is a sleeve valve). If this intervention is unsuccessful, an inner isolation string and seal may be run downhole between the bore of the no go nipple 80 located below and the packer bore located above.

As another example, if the packer 34 does not properly set, the following actions may be performed. If the packer 34 is partially set such that the packer 34 can hold some pressure but it is not steady, then pressure may be applied in the annulus to release the anchor latch 50 (assuming that the anchor latch 50 is released via annulus pressure) and the upper section 52 may be then pulled out of hole. Next, an isolation packer on top of the initial packer 34 is run downhole. If the packer 34 will not set at all, then the system 30 is retrieved from the well.

As another example, if a workover of the upper section 52 is needed, a plug may be placed in the no go profile 80 located below the packer 34; and the upper section 52 may be straight pulled after releasing the anchor latch 50. If the control line(s) passing through the packer 34 are considered a potential leak path, then a second packer may be set above the initial packer 34, and the second packer may be run at the bottom of the new upper completion run.

As yet another example, in case losses occur while running the single trip completion system 30 in hole, the following procedure may be used. If conditioned mud is left in the open hole, the filtercake should rebuild itself. Pills may be circulated to the bottom using the annular valve. A clean seal or another similar pill should stop the losses. Nevertheless, the thickness of the pill used in this situation is evaluated in order to identify any potential future restrictions. If the well needs to be controlled and control lines prevent the use of pipe rams, the packer 34 may be set to allow for bull heading the fluid in the formation.

Other variations are contemplated and may be considered within the scope of the appended claims. For example, instead of being part of the lower section 53, the inner tubing 110 (see FIG. 4) may be part of the upper section 52. If issues happen with the isolation vales 114, the screens 40 may be left in place while the inner tubing 110 may be removed with the upper section 52. Furthermore, if washing down is no longer a required option, the inner string 110 can be removed. This arrangement makes the system 30 simpler, lighter to run in open hole and faster to pick up. Washing down is no more an option, and the spotting filtercake treatment may become more challenging due to thief zones. The system 30 may be used with water injectors, as long as no lateral check valves are present.

As another example, the screens 40 may be plugged while running in hole and opened at a later stage. This arrangement permits removal of the inner tubing 110 while preserving the same functionalities.

Figure 8:
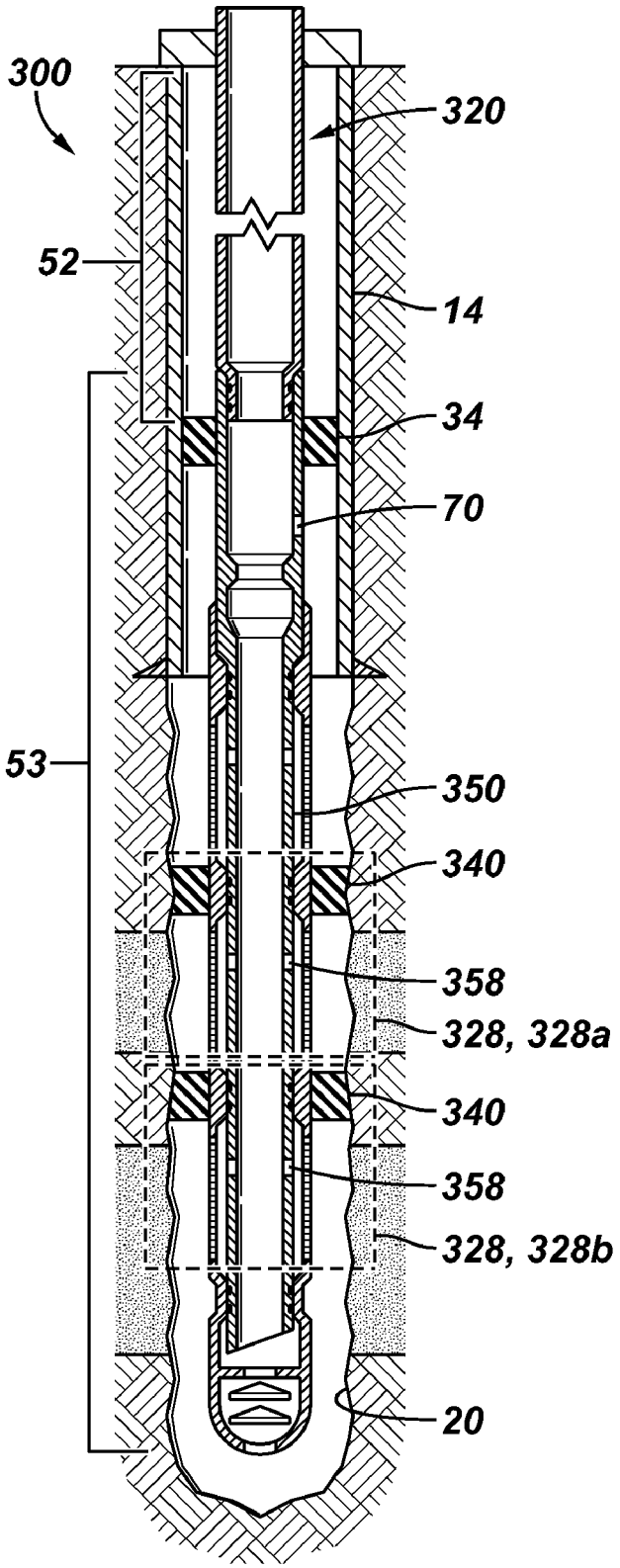
FIG. 8 is a schematic diagram of a multiple zone single trip completion system according to an example.

As another variation, the single trip completion system 30 may be replaced with a single trip completion system 320 that is depicted in FIG. 8. The single trip completion system 320 has many of the same features as the system 30, with like reference numerals being used to denote similar components. However, unlike the system 30, the single trip completion system 320 is a multiple zone intelligent screen completion system. The flow control devices 110 are replaced with flow control devices 358, and the lower completion is formed from one or more screen assemblies 328 (two screen assemblies 328*a* and 328*b* being depicted in FIG. 8 as examples). Each screen assembly 328 may be used to independently control a separate zone. It is noted that the system 320 may include more than the two depicted screen assemblies 328.

The single trip completion system 320 may include an inner tubing 350 that extends through the screen assemblies 328, and a polished bore receptacle (PBR) and seal arrangements, which are used to form seals between the screen of each screen section 328 and the exterior surface of the inner tubing 350. Furthermore, each screen assembly 328 may include a packer 340 to form a seal between the screen and the uncased or cased wellbore wall (shown here as uncased surrounding the screen assemblies 328). In accordance with some embodiments of the invention, each packer 340 may include a resilient element formed from a swellable material, although other types of packers may also be used.

The flow control devices 358 and the inner tubing 350 may have at least one of two constructions: the inner tubing 350 may be connected to the lower section 53; or the inner tubing 350 may be attached to the upper section 52. Each solution has its advantages and drawbacks. By connecting the inner tubing 350 to the lower completion 53, a control line from inside the system 320 may be passed outside via a feedthrough sub below the packer 34. Any potential leaks may be mitigated below the packer 34. Also, the relatively low pressure differential at the site of the completion makes the feedthrough substantially reliable. Control lines may extend through the packer feedthrough 34. However, this configuration does not permit the retrieval of the flow control valves 358 while retrieving the upper section 53.

In another arrangement in which the inner tubing 350 is connected to the upper section 52, the string 350 may be retrieved with the upper section 52. Nevertheless, this arrangement may present several challenges. In this regard, the valves and gauges must pass through the inner diameter of the packer 34 and are thus restricted in size by the inner diameter. In addition, the feedthrough of the control line occurs above the packer 34 where the differential pressure is higher and where leaks may be significantly more critical.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A completion system usable with a well, comprising:

a packer;

a screen to communicate well fluid between an annulus of the well and an interior passageway of the completion system; and a latch adapted to be selectively actuated downhole in the well via at least one remotely communicated control stimulus to release a portion of the completion system above the packer from a remaining portion of the completion system disposed below the latch;

an annulus communication valve located downhole of the packer and uphole of the screen to control communication with the annulus of the well, wherein the packer, the screen, the latch and the annulus communication valve are adapted to be run downhole as a unit into the well to complete the well.

2. The system of claim 1, further comprising:

a washdown shoe to be run downhole as part of the unit.

3. The system of claim 1, further comprising:

at least one isolation valve radially disposed inside the screen to control communication through the screen between the annulus and the interior passageway.

4. The system of claim 3, further comprising:

an inner tubing to be run downhole as part of the unit inside the screen and to form a sealed annular region between the screen and an exterior of the inner tubing, wherein said at least one isolation valve is adapted to control fluid communication through the screen between the annulus of the well and an interior space of the inner tubing.

5. The system of claim 3, wherein said at least one isolation valves comprises at least one check valve.

6. The system of claim 1, wherein the screen, at least one isolation valve, the annulus communication valve and the packer are part of the remaining portion of the completion assembly.

7. The system of claim 1, wherein the latch is adapted to be actuated while the unit is being run into the well.

8. The system of claim 1, further comprising a control line to communicate the at least one remotely communicated control stimulus downhole.

9. A completion system usable with a well, comprising:

a first packer;

a latch adapted to be remotely selectively actuated downhole in the well via a control line to release a portion of the completion system above the packer from a remaining portion of the completion system disposed below the latch;

an annulus communication valve disposed downhole of the first packer to control communication with an annulus of the well;

an inner tubing comprising an interior passageway; and at least one zone assembly, each zone assembly comprising:

a screen to communicate well fluid between the annulus of the well and the interior passageway of the inner tubing;

at least one isolation valve radially disposed inside the screen to control communication through the screen between the annulus of the well and the interior passageway; and a second packer, wherein the first packer, the latch, the annulus communication valve, the inner tubing and said at least one zone assembly are adapted to be run downhole as a unit into the well to complete the well.

10. The system of claim 9, wherein said at least one zone assembly is attached to the inner tubing, and the inner tubing and said at least one zone assembly are adapted to be retrieved through the first packer with said portion of the completion system after the latch releases said portion of the completion system.

11. The system of claim 9, wherein the latch is adapted to be actuated while the unit is being run into the well.

12. A method usable with a well, comprising:

running a unit into the well in a single trip to complete a segment of the well, the unit comprising a packer, a screen, an isolation valve and an annulus communication valve;

circulating fluid to remove debris from the well in a path that extends through the bottom of the unit, into the annulus and through the annulus communication valve;

after the circulating, landing a tubing hanger of the unit and setting the packer providing a latch to be run downhole as part of the unit, the latch adapted to be actuated to selectively release a portion of the unit above the packer;

actuating the latch to release the portion; and retrieving the portion from the well while leaving the remaining portion of the unit in the well.

13. The method of claim 12, further comprising:

producing well fluid from the well after the setting of the packer.

14. The method of claim 12, further comprising:

injecting fluid into the well after the setting of the packer.

15. The method of claim 12, further comprising:

installing a plug in an interior profile of the unit;

after the installation of the plug, releasing the latch; and retrieving the portion of the unit from the well.

16. A method usable with a well, comprising:

running a unit into the well in a single trip to complete a segment of the well, the unit comprising a first packer, an inner tubing and at least one zone assembly, each zone assembly comprising a screen to communicate well fluid between the annulus of the well and the interior passageway of the inner tubing, at least one isolation valve radially disposed inside the screen to control communication through the screen between the annulus of the well and the interior passageway, and a second packer;

circulating fluid to remove debris from the well in a path that extends through the bottom of the unit, into the annulus and through the annulus communication valve;

after the circulating, landing a tubing hanger of the unit and setting the first and second packers to establish at least one zone providing a latch to be run downhole as part of the unit, the latch adapted to be actuated to selectively release a portion of the unit above the first packer;

actuating the latch to release the portion; and retrieving the portion from the well while leaving the remaining portion of the unit in the well.

17. The method of claim 16, further comprising:

selectively opening said at least one isolation valve to produce well fluid from the well.

18. The method of claim 16 further comprising:

installing a plug in an interior profile of the unit;

after the installation of the plug, releasing the latch; and retrieving the upper portion of the unit out of the well.

19. The method of claim 16, further comprising:

releasing the latch; and retrieving the inner tubing and said at least one zone assembly through the first packer with said portion of the completion system.

* * * * *